US008848953B2

(12) United States Patent
Pape et al.

(10) Patent No.: US 8,848,953 B2
(45) Date of Patent: Sep. 30, 2014

(54) METHOD FOR THE OPERATION OF A HEARING DEVICE AND HEARING DEVICE WITH VARIABLE FREQUENCY SHIFT

(75) Inventors: Sebastian Pape, Erlangen (DE); Tobias Wurzbacher, Fuerth (DE); Stefan Petrausch, Erlangen (DE); Ulrich Kornagel, Erlangen (DE)

(73) Assignee: Siemens Medical Instruments Pte. Ltd., Singapore (SG)

( * ) Notice: Subject to any disclaimer, the term of this patent is extended or adjusted under 35 U.S.C. 154(b) by 38 days.

(21) Appl. No.: 13/807,957

(22) PCT Filed: Jun. 28, 2011

(86) PCT No.: PCT/EP2011/060849

§ 371 (c)(1),
(2), (4) Date: Jan. 2, 2013

(87) PCT Pub. No.: WO2012/001010

PCT Pub. Date: Jan. 5, 2012

(65) Prior Publication Data

US 2013/0108094 A1 May 2, 2013

Related U.S. Application Data

(60) Provisional application No. 61/361,017, filed on Jul. 2, 2010.

(30) Foreign Application Priority Data

Jul. 2, 2010 (DE) ..... 10 2010 025 918

(51) Int. Cl.
*H04R 25/00* (2006.01)

(52) U.S. Cl.
USPC ..... 381/316; 381/312; 381/318

(58) Field of Classification Search
CPC . H04R 25/00; H04R 2225/49; H04R 2460/01
USPC ..... 381/312, 316–318, 321
See application file for complete search history.

(56) References Cited

U.S. PATENT DOCUMENTS 6,498,858 B2 12/2002 Kates
7,778,426 B2 8/2010 McDermott et al.

(Continued)

FOREIGN PATENT DOCUMENTS

EP 1 033 063 B1 5/2003
EP 2 106 163 A2 9/2009

(Continued)

OTHER PUBLICATIONS

Schroeder, "Improvement of Acoustic-Feedback Stability by Frequency Shifting", Journal of the Acoustical Society of America, Sep. 1964, pp. 1718-1724, vol. 36, No. 9.

*Primary Examiner* — Suhan Ni
(74) *Attorney, Agent, or Firm* — Laurence A. Greenberg; Werner H. Stemer; Ralph E. Locher

(57) ABSTRACT

A method for the operation of a hearing device with at least one receiver includes carrying out a fixed second frequency shift of an electrical receiver signal supplying the receiver or of a predefinable frequency range of the receiver signal and a variable first frequency shift of the receiver signal or of a predefinable frequency range of the receiver signal. The first frequency shift is changed depending on the occurring feedback. A frequency shift which effectively prevents feedback is advantageously carried out, while artifacts of the frequency shift are minimized.

12 Claims, 3 Drawing Sheets

(56) References Cited

U.S. PATENT DOCUMENTS

| | | | |
|---|---|---|---|
| 8,170,248 | B2 | 5/2012 | Hersbach et al. |
| 2005/0226427 | A1 | 10/2005 | Hersbach et al. |
| 2005/0271222 | A1 | 12/2005 | Freed et al. |
| 2009/0245552 | A1 | 10/2009 | Salvetti |

FOREIGN PATENT DOCUMENTS

| | | | |
|---|---|---|---|
| GB | 1 597 501 | | 9/1981 |
| WO | 2007/053896 | A1 | 5/2007 |

METHOD FOR THE OPERATION OF A HEARING DEVICE AND HEARING DEVICE WITH VARIABLE FREQUENCY SHIFT

BACKGROUND OF THE INVENTION

Field of the Invention

The invention relates to a method for the operation of a hearing device and a hearing device with a variable second frequency shift of a receiver signal.

A frequent problem in the case of hearing devices is the feedback between the output of the hearing device and the input, which manifests itself as a disturbing whistling. FIG. 1 shows the principle of an acoustic feedback. A hearing device 1 has a microphone 2, which receives an acoustic useful signal 10, converts it into an electrical microphone signal 11 and emits it to a signal processing unit 3. In the signal processing unit 3 the microphone signal 11 is, inter alia, processed, amplified and emitted to a receiver 4 as an electrical receiver signal 12. In the receiver 4, the electrical receiver signal 12 is again converted into an acoustic output signal 13 and emitted to the eardrum 7 of a hearing device wearer.

The problem now consists in the fact that a part of the acoustic output signal 13 reaches the input of the hearing device 1 via an acoustic feedback path 14, where it overlays the useful signal 10 and is picked up by the microphone 2 as a cumulative signal. In the case of an unfavorable phasing and amplitude of the fed-back output signal a disturbing feedback whistling occurs. In particular in the case of an open hearing device supply, the attenuation of the acoustic feedback is low, whereby the problem is exacerbated.

To solve the problem, adaptive systems for feedback suppression have for some time been available. To this end, the acoustic feedback path 14 is digitally mapped in the hearing device 1. The mapping takes place, for example, by means of an adaptive compensation filter 5, which is fed by the receiver signal 12. After a filtering in the compensation filter 5, a filtered compensation signal 15 is subtracted from the microphone signal 11. In the ideal case the effect of the acoustic feedback path 14 is thereby canceled and a feedback-free input signal 16 is created for the signal processing unit 3.

For an effective feedback suppression, a regulation or adjustment of the filter coefficients of the adaptive compensation filter 5 is required. To this end the microphone signal 11 is analyzed with the aid of a detection unit 6 and investigated for possible feedback. By means of the regulation or adjustment respectively of the filter coefficients artifacts can however arise, as in the case of a adaptive compensation filter 5 which is not optimally set, extra signal components are generated or a feedback whistling occurs. EP 1 033 063 B1 discloses a hearing device with a feedback suppression, wherein for improvement of the feedback suppression, two adaptive compensation filters working in parallel are employed.

A high correlation between useful signal 10 and feedback signal 14 represents a major problem for optimal feedback suppression, because input signal components too are attacked by correlation and misadaptions of the compensation filter arise.

A solution for this problem is disclosed in the post-published DE 10 2010 006 154 A1. A useful signal is decorrelated from a fed-back interference signal, in that the frequencies of the output signal of a hearing device and thus the frequencies of the fed-back signals are shifted relative to the frequencies of the useful signal.

Unfortunately, the frequency shifts or as the case may be distortions also cause the markedly perceptible artifacts. As a rule, a distortion is not possible in the case of low frequencies, as human hearing reacts very sensitively to distortions in the low frequency range. Accordingly only the high frequencies are generally shifted. Despite this an audible "detuning" of the useful signal can arise here.

Significantly more unpleasant are overlay artifacts, in the case of which a signal shifted in the frequencies and an unshifted signal are perceived at the same time, which with tonal signals lead to a marked modulation or as the case may be, beat or a roughness. Acoustic overlays, which ensue as a result of the inflow of direct sound, for example through the vent, are almost unavoidable.

BRIEF SUMMARY OF THE INVENTION

Depending on the frequency shift, these overlays are perceived as amplitude modulation or as signal roughness. In all the cases described the overlays are disturbing, particularly when an input signal involves music or general tonal signals.

The object of the invention is to overcome these disadvantages and to specify a method and an associated hearing device, which reduce artifacts based on a frequency shift.

According to the invention, the problem posed is solved with the method and the hearing device from the independent claims.

The invention claims a method for the operation of a hearing device with at least one receiver. Depending on the feedback occurring, the receiver signal or a predefinable frequency range of the receiver signal is changed by a variable first frequency shift. For example the predefinable frequency range of the receiver signal is the same as the frequency range of the feedback occurring. The invention offers the advantage that precisely as much frequency shift is present as required to prevent "musical noise", but artifacts of the frequency shift are minimal. A very rapid response to feedback is thereby possible, and a feedback suppression is very stable.

In a further form of embodiment of the method the receiver signal or a predefinable frequency range of the receiver signal can be changed by a fixed second frequency shift.

In a development of the method, the variable first frequency shift can be increased depending on the size of the feedback occurring.

A further type of embodiment of the method can comprise a change of a variable adaption speed of a feedback suppression of the hearing device, depending on the feedback occurring.

Furthermore, the variable adaption speed can be increased depending on the size of the feedback occurring.

The invention also specifies a hearing device with a detection unit for the recognition of feedback and with at least one receiver. The hearing device additionally comprises a frequency shifting unit, which shifts the frequencies of an electrical receiver signal supplying the receiver or a predefinable frequency range of the receiver signal by a fixed second value and a variable first value. The first value can be changed depending on feedback occurring. For example the predefinable frequency range of the receiver signal is the same as the frequency range of the feedback occurring.

In a further type of embodiment the detection unit can increase the first value depending on the size of the feedback occurring.

In a development, the detection unit can actuate the frequency shifting unit using the first value.

In addition the hearing device can comprise an adaptive compensation filter for suppression of feedback. Its variable adaption speed changes depending on the feedback recorded by the detection unit.

In a development the variable adaption speed can increase depending on the size of the recorded feedback.

In addition, the detection unit can determine the variable adaption speed.

BRIEF DESCRIPTION OF THE SEVERAL VIEWS OF THE DRAWING

Further features and advantages of the invention are evident from the following explanations of a multiplicity of exemplary embodiments, based on schematic drawings.

Wherein.

DESCRIPTION OF THE INVENTION

Figure 1:
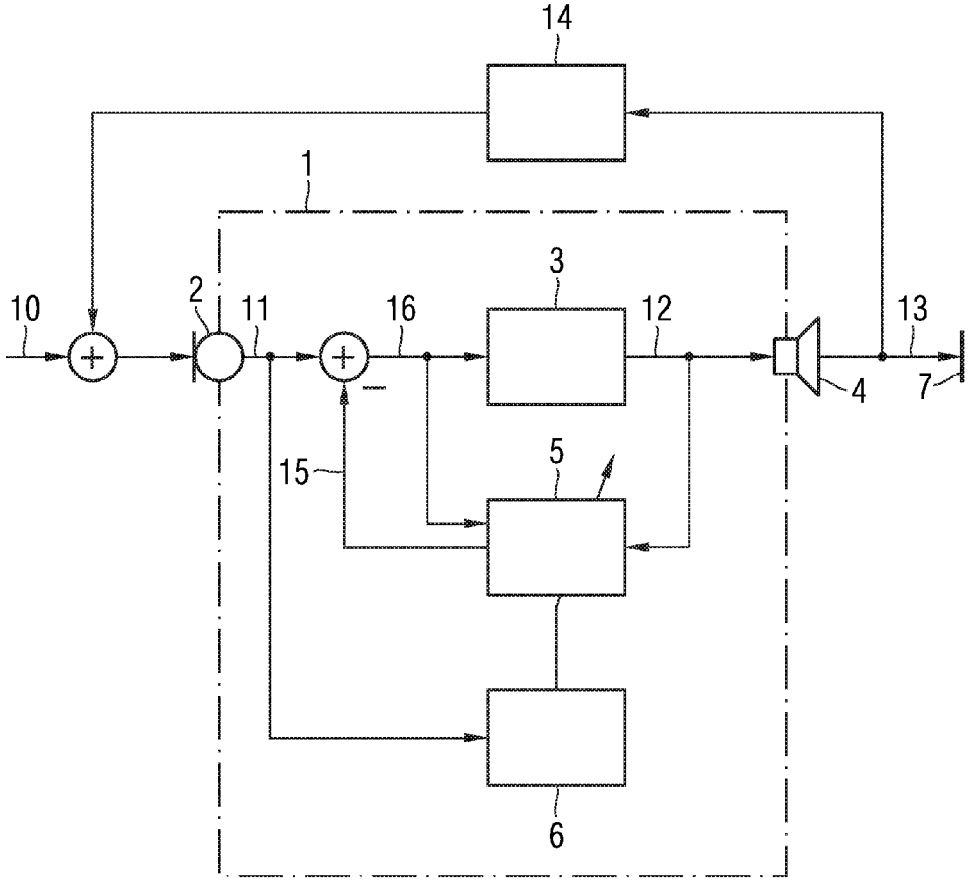
FIG 1 Prior art
FIG. 1: shows a block circuit diagram of a hearing device with an adaptive feedback suppression according to the prior art.
Figure 2:
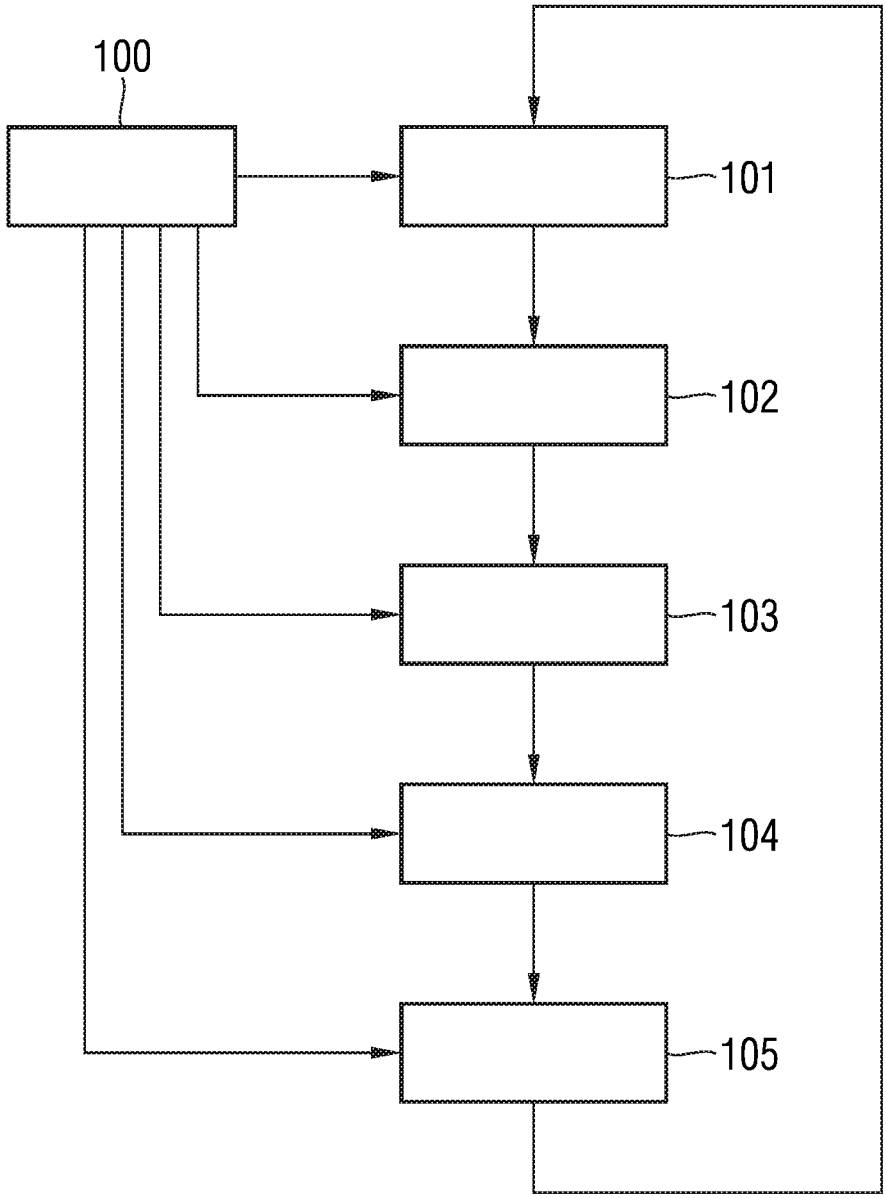
FIG. 2: shows a flow-chart of a method for the operation of a hearing device with variable frequency shift

FIG. 2 shows a flow-chart of an inventive method for the operation of a hearing device. Step 100 specifies an uninterrupted active feedback detection, which can recognize feedback from a microphone signal of the hearing device and its size or intensity respectively. An electrical receiver signal supplying a receiver of the hearing device or a predefinable frequency range of the receiver signal is frequency-shifted for the suppression of weak feedback in step 101 (=second frequency shift) in such a way that almost no artifacts are audible.

If the detected feedback exceeds a threshold value, in step 102 the frequencies of the receiver signal or a frequency range of the receiver signal are additionally shifted (=first frequency shift). The feedback occurring is effectively suppressed at the cost of audible artifacts. Additionally in step 103, upon the occurrence of feedback, the adaption speed of an adaptive feedback compensation filter is increased corresponding to its strength. The feedback suppression is thereby improved at the cost of audible artifacts.

If the feedback is below the threshold value or if it is lower, in step 104 the first frequency shift is canceled or as the case may be reversed, or reduced only according to the feedback still remaining. The increased adaption speed in step 105 is likewise reversed or adjusted to the new feedback situation.

Figure 3:
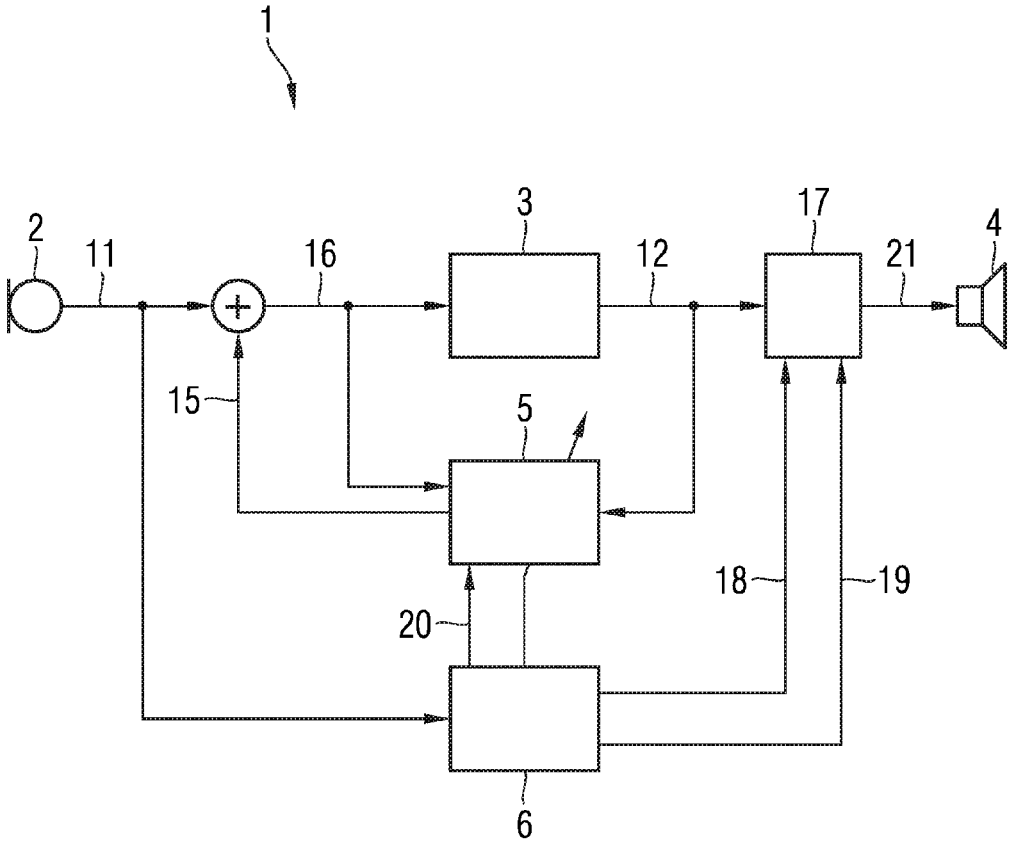
FIG. 3: block circuit diagram of a hearing device with a frequency shifting unit.

FIG. 3 shows a block circuit diagram of an inventive hearing device 1 with a microphone 2 for the conversion of sound waves into an electrical microphone signal 11, from which a compensation signal 15, which maps a feedback path between a receiver 4 and the microphone 2. The cumulative signal thus obtained is fed to a signal processing unit 3 of the hearing device 1 as the input signal 16. The signal processing unit 3 modifies and amplifies the input signal 16, and emits a modified and amplified receiver signal 12. For the reduction of feedback, the receiver signal is fed into a frequency shifting unit 17, which shifts the frequencies of the receiver signal 12. The frequency shifting unit 17 emits a frequency-shifted receiver signal 21 to the receiver 4, which converts the electrical frequency-shifted receiver signal 21 into an acoustic output signal.

The compensation signal 15 is formed by an adaptive compensation filter 5 from the receiver signal 12 and the input signal 16. For an effective feedback suppression, a regulation or as the case may be an adjustment of filter coefficients of the adaptive compensation filter 5 is required. To this end the microphone signal 11 is analyzed with the aid of a detection unit 6 and investigated for possible feedback. According to the invention, an adaption speed 20 of the compensation filter 5 is increased, if feedback is detected. The increase in the adaption speed 20 is dependent upon the strength of the detected feedback.

In the frequency shifting unit 17, the frequencies of the receiver signal 12, or part of the frequencies of the receiver signal 12, are shifted by a fixed second value 18, which can be prescribed by the detection unit 6. The second value 18 is selected to be so small that weak feedback is suppressed, but artifacts are still almost inaudible. In the case of stronger feedback, a variable first value 19 is transferred to the frequency shifting unit 17 by the detection unit 6. The receiver signal 12 or a selectable frequency range of the receiver signal 12 is now additionally frequency-shifted by the first value 19. By means of the variable first value 19 the frequencies of the receiver signal 12 are shifted on a situation-dependent basis, the stronger the feedback the stronger the frequency shift. If no feedback or a lower feedback occurs, the first value 19 is shifted or is even zero, that is to say the frequency shift is reduced. The adaption speed 20 is likewise again reduced.

LIST OF REFERENCE CHARACTERS

1 Hearing device
2 Microphone
3 Signal processing unit
4 Receiver
5 Adaptive compensation filter
6 Detection unit
7 Eardrum
10 Useful signal
11 Microphone signal
12 Receiver signal
13 Output signal
14 Feedback path
15 Compensation signal
16 Input signal
17 Frequency shifting unit
18 Second value
19 First value
20 Variable adaption speed
21 Frequency shifted receiver signal
100 Feedback detection
101 Second frequency shift
102 First frequency shift
103 Increase in adaption speed
104 Reversal of the first frequency shift
105 Reversal of the increase in adaption speed

The invention claimed is:

1. A method for the operation of a hearing device, the method comprising the following steps:

supplying an electrical receiver signal to at least one receiver;

changing a variable first frequency shift of the electrical receiver signal or of a predefinable frequency range of the electrical receiver signal, in dependence on occurring feedback; and carrying out a fixed second frequency shift, not equal to zero, of the electrical receiver signal supplying the receiver or of a predefinable frequency range of the electrical receiver signal.

2. The method according to claim 1, which further comprises increasing the variable first frequency shift in dependence on a size of the occurring feedback.

3. The method according to claim 1, which further comprises changing a variable adaption speed of a feedback suppression of the hearing device in dependence on the occurring feedback.

4. The method according to claim 3, which further comprises increasing the variable adaption speed in dependence on a size of the occurring feedback.

5. The method according to claim 1, which further comprises selecting the predefinable frequency range of the electrical receiver signal to be the same as a frequency range of the occurring feedback.

6. A hearing device, comprising:

a detection unit configured to detect feedback and supply a variable first value to be changed in dependence on occurring feedback;

at least one receiver configured to receive an electrical receiver signal; and a frequency shifting unit connected between said detection unit and said at least one receiver and configured to shift frequencies of the electrical receiver signal or a predefinable frequency range of the electrical receiver signal by the variable first value;

said frequency shifting unit being configured to shift the frequencies of the electrical receiver signal or the predefinable frequency range of the electrical receiver signal by a fixed second value not equal to zero.

7. The hearing device according to claim 6, wherein said detection unit is configured to increase the first value in dependence on a size of the occurring feedback.

8. The hearing device according to claim 7, wherein said detection unit actuates said frequency shifting unit using the first value.

9. The hearing device according to claim 6, which further comprises an adaptive compensation filter configured to suppress feedback, said adaptive compensation filter having a variable adaption speed changing in dependence on feedback recorded by said detection unit.

10. The hearing device according to claim 9, wherein said variable adaption speed increases in dependence on a size of the recorded feedback.

11. The hearing device according to claim 9, wherein said detection unit determines the variable adaption speed.

12. The hearing device according to claim 6, wherein the predefinable frequency range of the electrical receiver signal is the same as a frequency range of the occurring feedback.

* * * * *